United States Patent [19]

Vikersveen et al.

[11] Patent Number: 4,737,256

[45] Date of Patent: Apr. 12, 1988

[54] LAMINATED CARBON CATHODE FOR CELLS FOR THE PRODUCTION OF ALUMINIUM BY ELECTROLYTIC SMELTING

[75] Inventors: Stein Vikersveen, Årdalstangen; Johnny Torvund, Øvre Årdal, both of Norway

[73] Assignee: Ardal og Sunndal Verk a.s., Oslo, Norway

[21] Appl. No.: 921,418

[22] Filed: Oct. 22, 1986

[30] Foreign Application Priority Data

Oct. 24, 1985 [NO] Norway ..... 85 4250

[51] Int. Cl.[4] ..... C25B 11/02; H05B 3/60

[52] U.S. Cl. ..... 204/290 R; 204/294; 373/91; 373/54

[58] Field of Search ..... 204/294, 243 R, 290 R, 204/67; 373/54, 91, 92

[56] References Cited

U.S. PATENT DOCUMENTS

| | | | |
|---|---|---|---|
| 3,676,324 | 7/1972 | Mills | 204/290 R |
| 3,787,311 | 1/1974 | Wittner et al. | 204/294 |
| 3,851,377 | 12/1974 | Dumas et al. | 204/290 R |
| 4,076,610 | 2/1978 | Bizzarri | 204/290 R |
| 4,537,671 | 8/1985 | Zollinger et al. | 204/243 R |

FOREIGN PATENT DOCUMENTS

| | | | |
|---|---|---|---|
| 0032592 | 7/1911 | Norway | 373/91 |

*Primary Examiner*—John F. Niebling
*Assistant Examiner*—Kathryn Rubino
*Attorney, Agent, or Firm*—Wenderoth, Lind & Ponack

[57] ABSTRACT

A laminated carbon cathode includes two layers of carbon blocks, i.e. and the upper layer of graphite of graphitised carbon, and a lower layer of a cheaper anthracite carbon. The two layers are so displaced with respect to one another that there are no vertical seams leading straight from the upper surface of the carbon cathode to the its underside. Dividing the cathode into two horizontal layers is combined with the embedding of current-carrying steel conductors in precise grooves between the layers. In order to capitalize on the good electrical conductivity of aluminum, an aluminum extension is friction-welded to each steel conductor as close to a shell enclosing the cathode while at the same time a collar is formed which provides an air-tight seal at the point where the cathode bar enters the side of the shell. The proposed arrangement facilitates a very practical and simple check on dimensional deviations in the carbon blocks/cathode bars, and of fitting accuracy, by the visual inspection of seam tolerances and the displacement of axes during the lining operation.

7 Claims, 1 Drawing Sheet

LAMINATED CARBON CATHODE FOR CELLS FOR THE PRODUCTION OF ALUMINIUM BY ELECTROLYTIC SMELTING

BACKGROUND OF THE INVENTION

This invention relates to a laminated carbon cathode for use in the production of aluminum by electrolytic smelting.

A cell, or pot, for the production of aluminum by electrolytic smelting usually includes of a rectangular, low steel shell. The bottom and sides of this shell are, on the inside, lined with heat-insulating refractory bricks. On the high temperature side, that is on the inside of the heat insulation, the shell has a carbon lining. This lining is in the form of a shallow vessel which holds the bath and the aluminum that is precipitated during smelting. Inside the carbon lining there are steel bars, so-called cathode bars, to provide the electrical connection between the carbon cathode and external busbars.

The bath used for the electrolytic smelting of aluminum has a temperature of around 1000° C. and is aggressive. This makes the greatest demands on the lining of the smelting vessel, while at the same time, the bottom must be a good conductor of electricity. A large number of compounds e.g. diodes, nitrides and carbides, have been tested as lining materials, but the choice is still dominated by various types of carbon.

The selection of carbon materials for cathodes must take into account price and resistance against impregnation/penetration by compounds in the bath. Decisive for selection is the life of the cathode and the voltage drop through it.

It has now been found that a more or less graphitised cathode exhibits a higher resistance against impregnation and penetration by bath and metal, while at the same time its electrical conductivity is better than that of traditional carbon products on an anthracite base.

In many respects, electrodes of pure graphite would be preferable, but production capacity and price preclude a general adoption of pure graphite cathodes.

Carbon linings are built up of carbon blocks placed alongside one another. They are bonded together by various types of adhesive or tamping paste which is pressed into the seams (slots) between the blocks.

It is these seams which are the weakest element in the carbon lining. The final curing, or hardening, of these seams takes place during the starting of the cell, and it is difficult to achieve optimum heat treatment. The tamping paste also contains volatile substances, with the result that the paste in the slots, after the thermal treatment during the start of the cell, tends to shrink and become porous, and more permeable than the rest of the carbon lining.

Bath and molten metal can penetrate through faulty slots between the carbon blocks, impairing the insulating properties of the refractory lining and attacking the cathode bars. When a pot produces aluminum with unwanted iron and silicon content, this is a warning that the cell is reaching the end of its operating life.

A further process which can help to reduce the operating life of a cell is the oxidation of the cell's carbon side-lining caused by air entering through the holes in the side of the steel shell for the cathode bars.

BRIEF DESCRIPTION OF THE DRAWINGS

This invention counteracts the difficulties discussed above, and will be described in detail below with reference to the accompanying drawings, wherein.

DETAILED DESCRIPTION OF THE INVENTION

Figure 1:
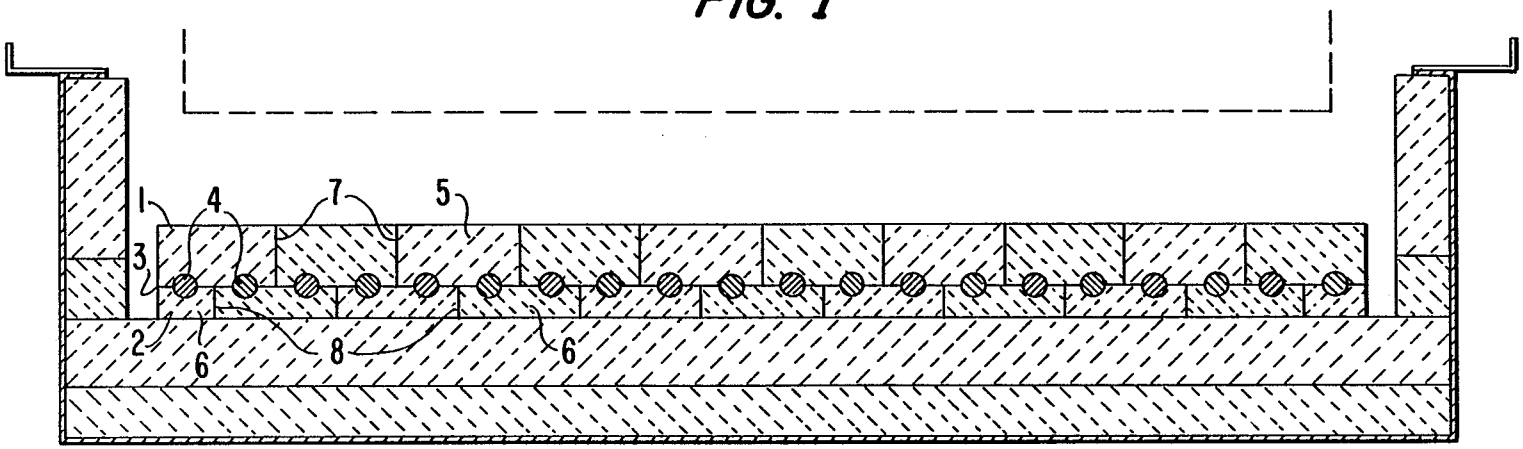
FIG. 1 is a schematic sectional view through a cell including a cathode according to the present invention.
Figure 2:
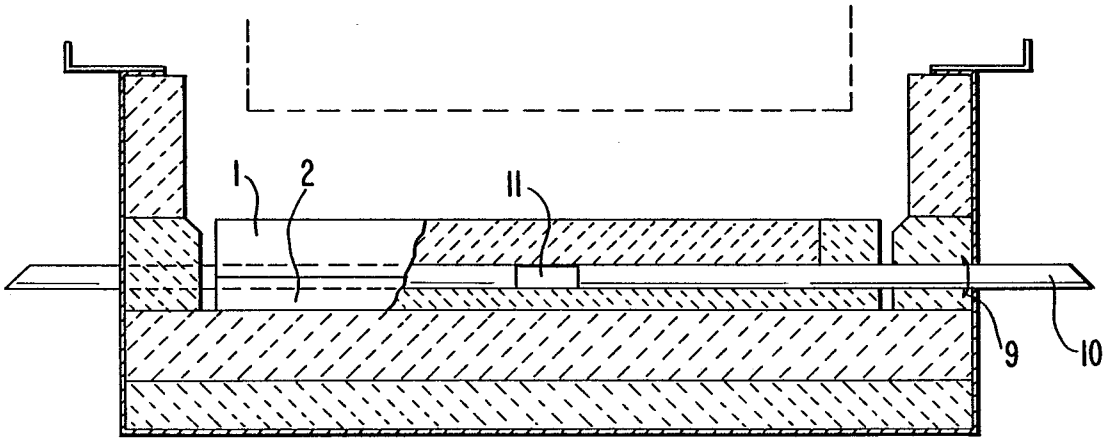
FIG. 2 is a schematic sectional view thereof taken transverse to the plane of FIG. 1.

The invention concerns a laminated carbon cathode for the production of aluminum by electrolytic smelting in that the carbon cathode is divided into two horizontal layers 1 and 2, of carbon blocks 5 and 6 made of different types, with a horizontal seam 3 between the layers of carbon blocks and at the same level as cathode bars 4. There are two cathode bars 4 in each whole block, and the carbon blocks in the two layers are so laid that the vertical slots between the blocks in each layer are displaced or so staggered horizontally so that an upper seam 7 and a lower seam 8 are disposed on respective sides of each cathode bar 4.

In a preferred embodiment of the invention, the carbon blocks in the upper layer 1 consist of graphite or graphitised carbon, while the blocks in the lower layer 2 consist of carbon blocks on an anthracite base.

This arrangement reduces the quantity of the more expensive carbon blocks. Further, the staggering of the seams gives greater security against penetration of bath and molten metal in that there are no longer any vertical seams leading straight down from the upper surface of the carbon cathode to the refractory lining. In addition, the path is longer because of the horizontal seam between the upper and lower carbon layers.

To derive the full benefit of the invention it is necessary to use an expedient adhesive with a high coke yield after heat treatment. In a preferred embodiment, this adhesive consists of a finely dispersed carbon aggregate and a furan-based or phenol-based resin, as for example described in European patent document No. EP 0075 279 B1.

It is of course possible to use cathode bars of various cross sections, but in a prefered embodiment round cathode bars 4 have been selected, these being laid in the middle between the lower layer of carbon blocks 2 and the upper layer of carbon blocks 1, there being semicircular grooves in the upper carbon blocks 5 and in the lower carbon blocks 6. A circular cross section is efficient for electrical conductivity, while the circular surface provides good contact with the carbon lining under normal operating conditions.

The choice of round cathode bars permits the friction welding, by known methods, of the cathode bar to an aluminum extension 10 which, once the cathode bar is in place, can be welded to the external aluminum busbar system which connects the cells together. Using aluminum as an electrical conductor as far as possible up to the cathode bar will reduce the voltage drop, and thus the total energy loss.

The loss through the weld is lower than that through a screw connection, and furthermore it does not deteriorate with time. Also no subsequent tightening is necessary.

In a preferred embodiment of the cathode bar, a collar 9 will automatically be formed by the welding operation, and this is used as a sealing flange against the side wall in the cathode shell where the cathode bar enters the side of the shell. This obviates the necessity for more costly and impractical separate sealing arrangements on the outside of the steel shell, for example, conventional welded-on stuffing box arrangements.

Cathode bars expand considerably lengthwise when they are heated to a normal operating temperature, around 900° C. It is therefore necessary to divide the cathode bar 10 into two parts, with a space 11 to allow for expansion away from the side wall, which would otherwise be bent outwards, and thus weakening the structure.

The fitting of cathode linings is time-consuming, and results in a production loss if relining takes place in the cell in situ in the potroom. This invention simplifies the laying of carbon blocks and cathode bars in the cathode shell. Further, this system permits more extensive use of standard block dimensions, and thus better utilization of the carbon blocks when they are machined.

We claim:

1. A laminated carbon cathode for use in an electrolytic cell for the production of aluminum by electrolytic smelting, said cathode comprising:

upper and lower horizontal layers of carbon blocks, said carbon blocks of said upper layer being of carbon of a different type than said carbon blocks of said lower layer;

said upper and lower layers being separated by a horizontal seam, said blocks of said upper layer being separated by upper vertical seams, and said blocks of said lower layer being separated by lower vertical seams;

a plurality of cathode bars extending horizontally between said upper and lower layers at the level of said horizontal seam, with two said cathode bars being in each whole block of said upper and lower layers; and said upper and lower vertical seams being horizontally staggered such that respective upper and lower vertical seams are positioned at opposite sides of each said cathode bar.

2. A cathode as claimed in claim 1, wherein said carbon blocks of said upper layer are formed of graphite or graphitised carbon, and said carbon blocks of said lower layer are formed of carbon of an anthracite base.

3. A cathode as claimed in claim 1, wherein said layers are bonded together by an adhesive consisting of polymerizable hydrocarbons with a high carbon content.

4. A cathode as claimed in claim 1, wherein said cathode bars have a round cross section and fit within semi-circular grooves formed in said carbon blocks of said upper and lower layers.

5. A cathode as claimed in claim 1, wherein each said cathode bar is formed of steel.

6. A cathode as claimed in claim 1, wherein each said cathode bar is friction welded to an aluminum extension to be connected to an external bushbar system.

7. A cathode as claimed in claim 6, wherein a collar is formed by such friction welding and forms a sealing flange for sealing against a shell of the cathode at a point where said cathode bar is to extend through such shell.

* * * * *